US006319183B1

(12) United States Patent
Ballos, III

(10) Patent No.: US 6,319,183 B1
(45) Date of Patent: Nov. 20, 2001

(54) METHOD AND APPARATUS FOR SETTING UP A BOX ERECTING MACHINE

(75) Inventor: Pete Ballos, III, Canton, OH (US)

(73) Assignee: Combi Packaging Systems LLC, Canton, OH (US)

( * ) Notice: Subject to any disclaimer, the term of this patent is extended or adjusted under 35 U.S.C. 154(b) by 0 days.

(21) Appl. No.: 09/182,908

(22) Filed: Oct. 30, 1998

(51) Int. Cl.[7] ..... B31B 1/00

(52) U.S. Cl. ..... 493/37; 493/25; 493/309; 493/475; 493/478; 493/479

(58) Field of Search ..... 493/37, 475, 476, 493/25, 52, 309, 478, 479

(56) References Cited

U.S. PATENT DOCUMENTS

| | | | | |
|---|---|---|---|---|
| 3,270,628 | | 9/1966 | Clem | 93/52 |
| 3,273,472 | | 9/1966 | Van Antwerpen et al. | 93/53 |
| 3,652,080 | * | 3/1972 | Jenkins | 270/61 R |
| 3,884,130 | | 5/1975 | Stolkin et al. | 93/49 |
| 4,018,143 | * | 4/1977 | Dice, Jr. et al. | 93/36.3 |
| 4,224,781 | | 9/1980 | Salenbo | 53/473 |
| 4,285,679 | * | 8/1981 | Wahle | 493/125 |
| 4,317,319 | * | 3/1982 | Price | 493/25 |
| 4,437,851 | | 3/1984 | Salenbo | 493/124 |
| 4,439,174 | * | 3/1984 | Derderian | 493/125 |
| 4,554,777 | | 11/1985 | Denk et al. | 53/201 |
| 4,565,048 | | 1/1986 | Lade | 53/201 |
| 4,578,052 | * | 3/1986 | Engel et al. | 493/11 |
| 4,674,998 | * | 6/1987 | Benedicenti | 493/164 |
| 4,821,203 | * | 4/1989 | Carlton et al. | 493/25 |
| 5,372,569 | * | 12/1994 | Ballos, III | 493/316 |
| 5,480,370 | * | 1/1996 | Gelsinger | 493/475 |
| 5,689,931 | | 11/1997 | Bridges et al. | 53/64 |
| 5,713,187 | * | 2/1998 | Peterson | 53/566 |
| 5,772,568 | * | 6/1998 | Chen | 493/116 |

* cited by examiner

*Primary Examiner*—Ed Tolan
(74) *Attorney, Agent, or Firm*—Sand & Sebolt

(57) ABSTRACT

A box erecting machine that can readily be set up to assemble boxes of different sizes contains pointers and scales permitting the vertical and horizontal adjustment of the box magazine, the centering of the flap folding structures, and the vertical adjustment of the box hold down plates to be readily set according to the dimensions of the box to be assembled. The vertical adjustment of the box magazine, the horizontal adjustment of the box magazine, and the centering of the flap closure apparatus are adjusted until the corresponding pointer and scale of those structures indicate the width measurement taken directly from the box. The hold down plate assembly is adjusted until the corresponding pointer and scale indicate the height of the box as measured directly therefrom. Horizontal adjustment of box magazine width and horizontal adjustment of an adjustable guide rail are performed against an actual box placed in those structures. Alternatively, the scales corresponding to the critical parameters can be pre-marked with graduations corresponding with the boxes typically assembled by the user.

20 Claims, 10 Drawing Sheets

METHOD AND APPARATUS FOR SETTING UP A BOX ERECTING MACHINE

BACKGROUND OF THE INVENTION

1. Technical Field

The invention relates generally to box erecting machines and, more particularly, to a box erecting machine that can be readily set up to assemble boxes of different sizes. Specifically, the invention relates to a box erecting machined that is set up by adjusting a plurality of box manipulation stations to correspond with settings on scales located on the machine with the scale settings corresponding to the dimensions of the box to be assembled.

2. Background Information

Essentially all commercial goods travel through commerce enclosed in some type of packaging. Among the most common types of packaging are boxes (also referred to as carton or cases) of a rectangular solid shape and that are typically manufactured of corrugated cardboard. Such boxes are of innumerable shapes and sizes suited to the specific needs of the packaging application. One such type of box is a parallelepiped carton with inward-turned flaps on at least the bottom thereof.

Unassembled parallelepiped cartons are typically cut from a single sheet of material and then formed into a generally tubular configuration having four sides. Each side terminates with a top flap and a bottom flap at opposed ends thereof. The top flaps and bottom flaps are folded inwardly and sealed to form top and bottom sides, respectively. Such boxes are typically shipped from a box manufacturer in a flat configuration as blanks and must be assembled into a three-dimensional box prior to use. Such assembly can be by hand or through the use of a box erecting machine.

The flaps of a box are designated in the art as "major" and "minor" depending on their relative length. For instance, in a parallelepiped box having a length, a width, and a height, with the length and width being unequal, the major flaps arts the two opposed flaps lying adjacent the longer of the length and width, with the minor flaps being the flaps adjacent the shorter of the length and the width. In the parlance of the relevant art, the major flaps are attached to the "major" panels of the box, and the minor flaps are attached to "minor" panels on the box. While many parallelepiped boxes contain bottom-forming flaps and top-forming flaps, some parallelepiped boxes contain only bottom-forming flaps, with the fully assembled box having an open top.

Parallelepiped boxes are assembled by first drawing the unassembled, flat box into a generally tubular rectangular shape. The minor flaps are each folded 90 degrees inward, with the major flaps then being folded 90 degrees inward and over the minor flaps. The flaps may then sealed in place using glue, adhesive tape, gummed tape, or other such materials that are known and understood in the relevant art.

Such operations often are performed by a box erecting machine as part of an assembly line operation. The box erecting machine typically includes a magazine that holds a plurality of box blanks. The blanks are opened in turn into the tubular form and the bottom flaps thereof are then folded to form a bottom. The boxes are then appropriately filled and the top flaps thereof assembled.

In one box erecting machine known in the art, box blanks are loaded into a magazine and are removed in turn from the magazine by a suction catcher. The suction catcher pneumatically attaches to a major panel of the box, pulling the box from the magazine. An unfolding plate then rotates the minor panel that is initially coplanar with the major panel through an angle of approximately 90 degrees, thus opening the box into a generally tubular shape. One of the bottom flaps may be flipped up at this time to being the bottom-closing. A push bar then pushes the box by a minor panel toward the flap folding and taping structures of the machine.

The bottom flaps of a parallelepiped box are often assembled first with the top flaps being left open or unassembled so that the box can be filled within the appropriate contents. After the box has been filled, the final step is to fold and seal the top flaps of the box. The top flaps are sealed in a manner similar to the sealing of the bottom flaps, i.e., folding the minor flaps 90 degrees inward, folding the major flaps 90 degrees inward and over the minor flaps, and then sealing the major flaps in position with glue, adhesive tape, gummed tape, or the like.

Box erecting machines of the type described above are rather complex and expensive machines that are permanently installed in production lines and are typically capable of being set up to assemble boxes of different sizes. The magazines of these machines are adjustable to allow different sized boxes to be loaded into the machine for set up. Such machines typically contain adjustable guide rails that define a feed path. The guides maintain the boxes in a proper orientation as they pass over the folding and taping structures of the machine.

One such type of box erecting machine utilizes a fixed guide rail and an adjustable guide rail with the adjustable guide rail being adjusted to correspond with width of the box being assembled. As is understood in the relevant art, the taping and folding operations occur are destroyed to function when aligned with the center of the box width. When the adjustable guide rail is adjusted to accommodate a box of a different width, the center line of the box where the folding and taping operations occur is correspondingly shifted laterally. Thus, a box erecting machine having a fixed guide rail and an adjustable guide rail additionally contains an adjustment system that permits the box folding and taping structures to move correspondingly with the center line of the box. The box erecting machine also has hold down plates that contact the top of the box to hold it in position. The position of the hold down plates is also adjustable to accommodate boxes of different heights.

One reason for designing machinery to contain a fixed guide rail and a moveable guide rail with correspondingly moveable box folding and taping structures is to permit the boxes, as they are assembled, to travel along a fixed, constant "index" line. Inasmuch as the boxes are assembled for the purpose of carrying goods, the goods must, at some point, be loaded into the boxes. Boxes traveling through a production line along a fixed index line are more easily filled than boxes that are delivered centered along a conveyor system because such centered boxes typically require a longer reach by the individual who loads or the machinery that loads the box. Cartons traveling along a common index line can be filled directly from the index line with minimal reach and minimal wasted effort. Additionally, the use of a common index line for filling boxes expedites the setup of automated machinery used to fill the boxes.

One drawback to the use of such versatile machinery is, however, that the machinery must be painstakingly set up to properly assemble the desired box. When the machinery must be set up to assemble a different sized box, many adjustments must be made to the machine to ensure that the box is properly assembled and so that jamming and other feeding and conveyance problems are obviated. Such setup is time consuming and requires significant effort and results in substantial downtime for the entire production line. The set up is tested by loading box blocks in the magazine and running the machine. An incorrect setting yields a destroyed box that must be discarded.

A need thus exists for a box erecting machine that is capable of assembling boxes of different sizes while being able to set up to assemble a box of a different size with minimal effort and minimal downtime. Such an improved box erecting machine would preferably contain pointers operatively positioned adjacent each of the adjustable structures with each adjustable structure being adjusted until the relevant pointer registers a desired setting on a corresponding scale having graduations related to dimensions or other aspects of the box to be assembled.

SUMMARY OF THE INVENTION

In view of the foregoing, an objective of the present invention is to provide a box erecting machine that can readily be set up to assemble boxes of different sizes.

Another objective of the present invention is to provide a box erecting machine utilizing pointers and corresponding scales that allow the machine to be set up based on the dimensions of the box to be assembled.

Another objective of the present invention is to provide a box erecting machine that can readily be set up based on the measured width and height of the box.

Another objective of the present invention is to provide a box erecting machine that can be readily set up based on a stock number or product number associated with the box.

Another objective of the present invention is to provide a box erecting machine that uses set up mechanisms and scales that are simply and easy to read without requiring the person setting up the machine to perform any calculations.

Another objective of the present invention is to provide a method for setting up a box erecting machine that is simple, inexpensive, and may be performed on existing box erecting machine by retrofitting them with the appropriate scales and pointers.

These and other objectives and advantages of the invention are obtained by a box erecting machine for erecting a given box, the machine comprising a frame; at least one box manipulation station adjustably mounted on said frame; a first scale mounted on one of said box manipulation station and said frame; and a first pointer mounted on one of said box manipulation station and said frame, said pointer and said scale positioned to provide an indication of the location of said box manipulation station with respect to said frame, the indication being scaled to the given box.

Other objectives and advantages of the invention are achieved by a method for setting up an adjustable station of a box erecting machine to function with a given box, the given box having a width and a height, the box erecting machine having a frame, the method comprising the steps of providing a scale on one of the adjustable station and the frame of the box erecting machine; providing a pointer on the other of the adjustable station and the frame of the box erecting machine; and adjusting the position of the adjustable station with respect to the frame until the pointer reaches a first setting on the scale, the first setting corresponding to the given box.

BRIEF DESCRIPTION OF THE DRAWINGS

The preferred embodiment of the invention, illustrative of the best mode in which the applicant contemplates applying the principles of the invention, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 4A:
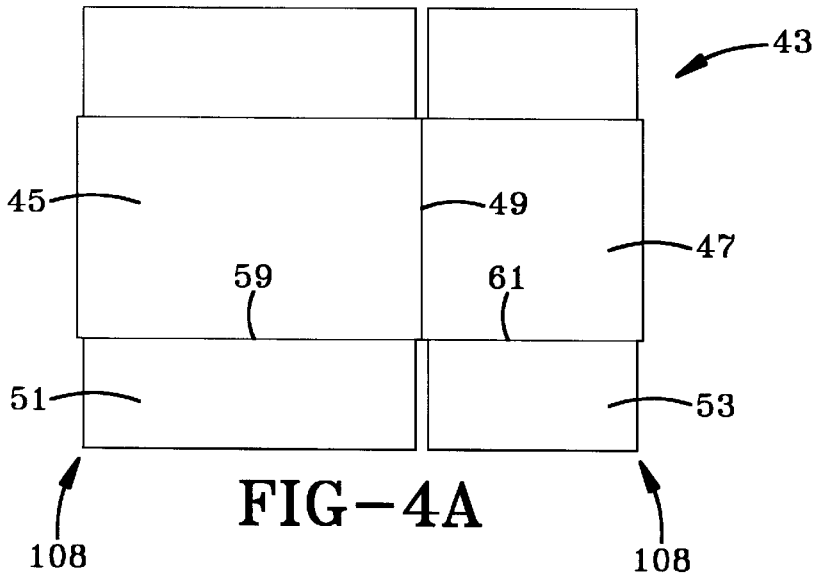
FIG. 4A is a front elevational view of a box in a flat, unfolded configuration as it would be loaded into the box magazine prior to being assembled.

The box erecting machine of the present invention is indicated generally by the numeral 2 in the accompanying drawings. Box erecting machine 2 includes a frame 4 with a plurality of box manipulation stations adjustable mounted on the frame. The manipulation stations include a box unfolding station 6, a flap folding station 8, and a box taping station 10. Box erecting machine 2 folds boxes from an initially flat, unfolded configuration (FIG. 4A) into parallelepiped boxes having folded and taped bottoms. One type of box erecting machine 2 that may be used with the concepts of the present invention is disclosed in U.S. Pat. No. 4,285,679, the disclosures of which are specifically incorporated herein by reference.

Box unfolding station 6 includes a box magazine 12 and a box unfolding assembly 14. Box magazine 12 includes a scaled channel 16 and a non-scaled channel 18 parallel and spaced apart from one another. Scaled channel 16 contains a vertical face 17 that faces non-scaled channel 18. Scaled channel 16 and non-scaled channel 18 are both attached to a carriage 20 that is adjustably mounted on frame 4. Scaled channel 16 and non-scaled channel 18 are both slidably mounted on a pair of magazine slide bars 22 fixedly attached at both ends thereof to carriage 20. Scaled channel 16 and non-scaled channel 18 each contain a pair of locking levers 24 that permit channels 16 and 18 to be locked in position along magazine slide bars 22.

Figure 2:
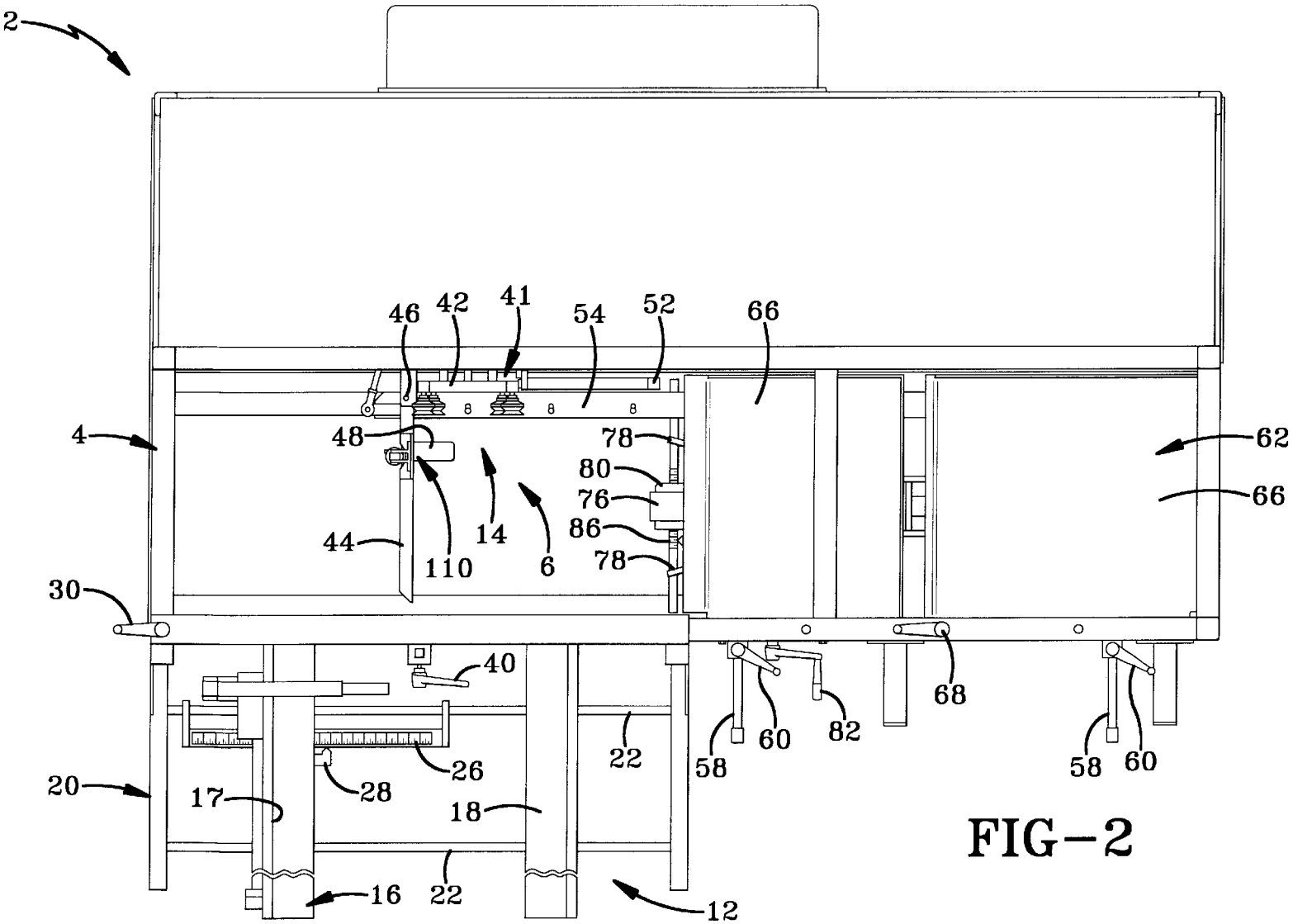
FIG. 2 is a top plan view of the box erecting machine of the present invention.
Figure 6:
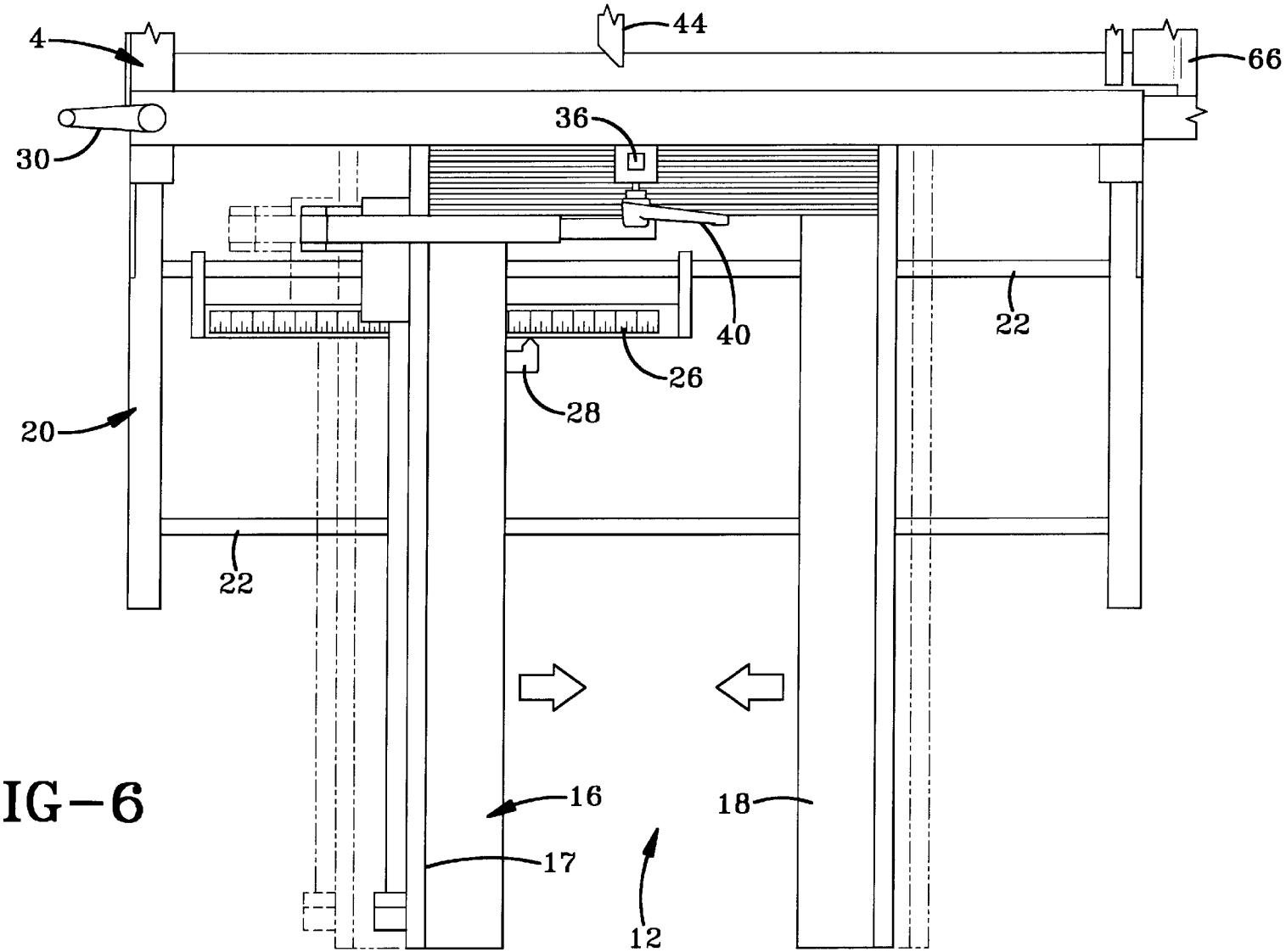
FIG. 6 is a top plan view of a portion of the box erecting machine depicting horizontal movement of the box magazine.

As shown in FIGS. 2 and 6, a magazine width scale 26 is located on one of magazine slide bars 22, and a magazine width pointer 28 is mounted on scaled channel 16. In other embodiments of the invention, pointer 28 may be integrally formed on channel 16 or may simply be a part of channel 16. As can be seen in FIG. 6, sliding movement of scaled channel 16 along magazine slide bars 22 results in corresponding movement of magazine width pointer 28 along magazine width scale 26. Non-scaled channel 18 likewise slides along magazine slide bars 22, but does not contain a pointer or a corresponding scale. Scaled channel 16 and nonscaled channel 18 are of a general L-shape and are intended to carry a number of boxes in a flat, unfolded configuration (FIG. 4A) as will be set forth more fully below.

Figure 3:
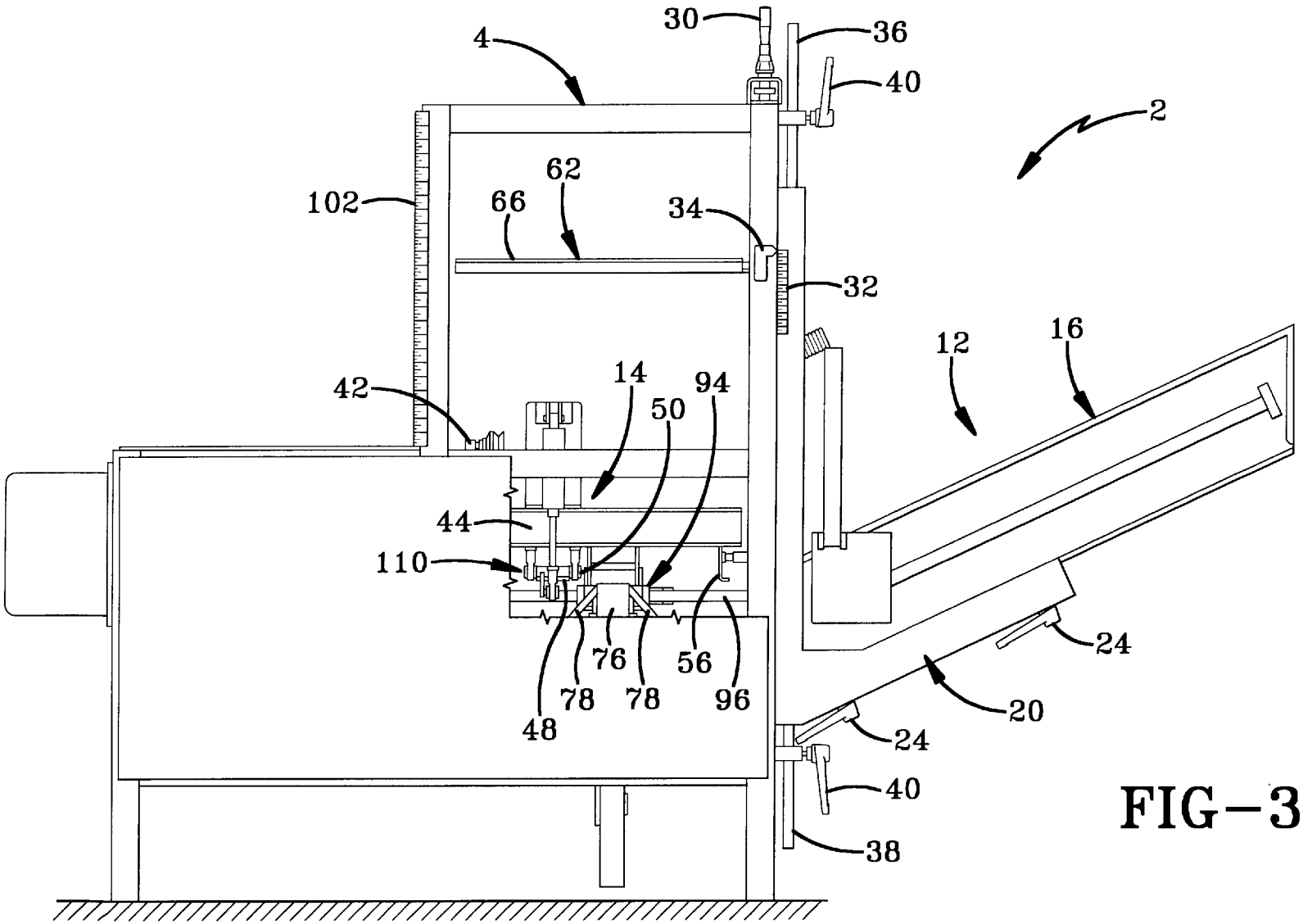
FIG. 3 is a partially cut away left side elevational view of the box erecting machine of the present invention.

Carriage 20 is adjustable in the vertical direction with respect to frame 4 by operation of a threaded magazine height adjustment crank 30 that is rotatably mounted on frame 4 and threadably engaged with a threaded collar (not shown) mounted on carriage 20. As can be seen in FIG. 3, a magazine height scale 32 is located on carriage 20, and a magazine height pointer 34 is mounted on an upright portion of frame 4.

Thus, in accordance with the features of the present invention, box magazine 12 is adjustable in the horizontal direction by the sliding movement of scaled channel 16 and non-scaled channel 18 and is adjustable in the vertical direction by movement of carriage 20 by operation of magazine height adjustment crank 30. Box magazine 12 additionally includes an upper spring bar 36 and a lower spring bar 38 that assist in holding boxes in box magazine 12 at the proper orientation for removal and folding by box unfolding assembly 14. Upper spring bar 36 and lower spring bar 38 are both slidably adjustable in the vertical direction and are each lockable by a locking lever 40.

Box unfolding assembly 14 includes a box unfolding frame 41, a suction catcher 42 that is selectively extendable from box unfolding frame 41, a box unfolding plate 44 pivotally attached to box unfolding frame 41 on an unfolding pivot 46, and a kick plate 48 pivotally attached to box unfolding plate 44 on a flap folding pivot 50. A push bar 52 is also mounted on box unfolding frame 41.

Box unfolding assembly 14 operates on a box 43 having a pair of major panels 45 and a pair of minor panels 47, with major panels 45 and minor panels 47 meeting at panel junctures 49. Major panels 45 each terminate with a pair of major flaps 51 at opposite ends thereof, and minor panels 47 each terminate with a pair of minor flaps 53 at opposite ends thereof. Major flaps 51 each meet a major panel 45 at a major flap juncture 59. Minor flaps 53 each meet a minor panel 47 at a minor flap juncture 61.

In operation, suction catcher 42 extends using known means from box unfolding frame 41 toward box magazine 12. Suction catcher 42 pneumatically captures box 43 by major panel 45 and pulls box 43 from box magazine 12 by returning toward box unfolding frame 41. Box unfolding plate 44 then rotates about unfolding pivot 46, thus rotating minor panel 45 about panel juncture 49 until box unfolding plate 44 is substantially perpendicular to suction catcher 42. Thus, box 43 is unfolded into a generally tubular configuration. Major panel 45 remains attached to suction catcher 42, and minor panel 47 lies adjacent box unfolding plate 44. Kick plate 48 then rotates about flap folding pivot 50 until kick plate 48 is substantially horizontal, thus folding minor flap 53 (the trailing flap) up to its folded position.

Box unfolding frame 41, with box 43 attached between suction catcher 42 and box unfolding plate 44, then transports box 43 toward flap folding station 8. In so doing, push bar 52 is attached to and translates with box unfolded frame 41 and pushes any other box that is in flap folding station 8 toward box taping station 10, thus clearing flap folding station 8 for box 43.

Once box unfolding frame 41 has moved box 43 sufficiently toward flap folding station 8, suction catcher 42 releases box 43 and push bar 52 rotates upwardly through an angle of approximately 90 degrees or is otherwise removed. Box unfolding frame 41 then translates back to the position depicted in FIG. 2. Push bar 52 is thus depicted in FIG. 2 in the vertical orientation prior to its return to a horizontal position, and box unfolding plate 44 is depicted therein in an orientation perpendicular to suction catcher 42 before it has returned to its ready position.

Boxes being pushed through box erection machine 2 over flap folding station 8 and box taping station 10 pass between and are held in rectangular alignment by a fixed guide rail 54 and an adjustable guide rail 56 parallel and spaced apart from fixed guide rail 54. Fixed guide rail 54 is fixedly attached to frame 4. In accordance with the objectives of the invention, the edge of fixed guide rail 54 facing adjustable guide rail 56 provides an index line 55 against which all boxes passing through box erecting machine 2 are aligned.

Adjustable guide rail 56 is selectively lockable by the action of a pair of locking levers 60 that selectively lock a pair of lock bars 58 that are each fixedly attached to adjustable guide rail 56 and slide through a hole in frame 4. Adjustable guide rail 56 is adjusted by releasing locking lever 60, adjusting guide rail 56 to the desired position between minimum inward and maximum outward limiting positions depending upon the width of the box to be assembled, and engaging locking levers 60 to lock adjustable guide rail 56 in the desired position.

An operational perimeter is defined between imaginary planes extending vertically from the surfaces of guide rails 54 and 56 facing one another, the planes being substantially parallel with each other and terminating at an upper end at an adjustable box hold down assembly 62. Holding and taping operations are performed inside the operational perimeter of box erecting machine 2, and the operational perimeter thus varies with the positions of adjustable guide rail 56 and box hold down assembly 62.

Figure 9:
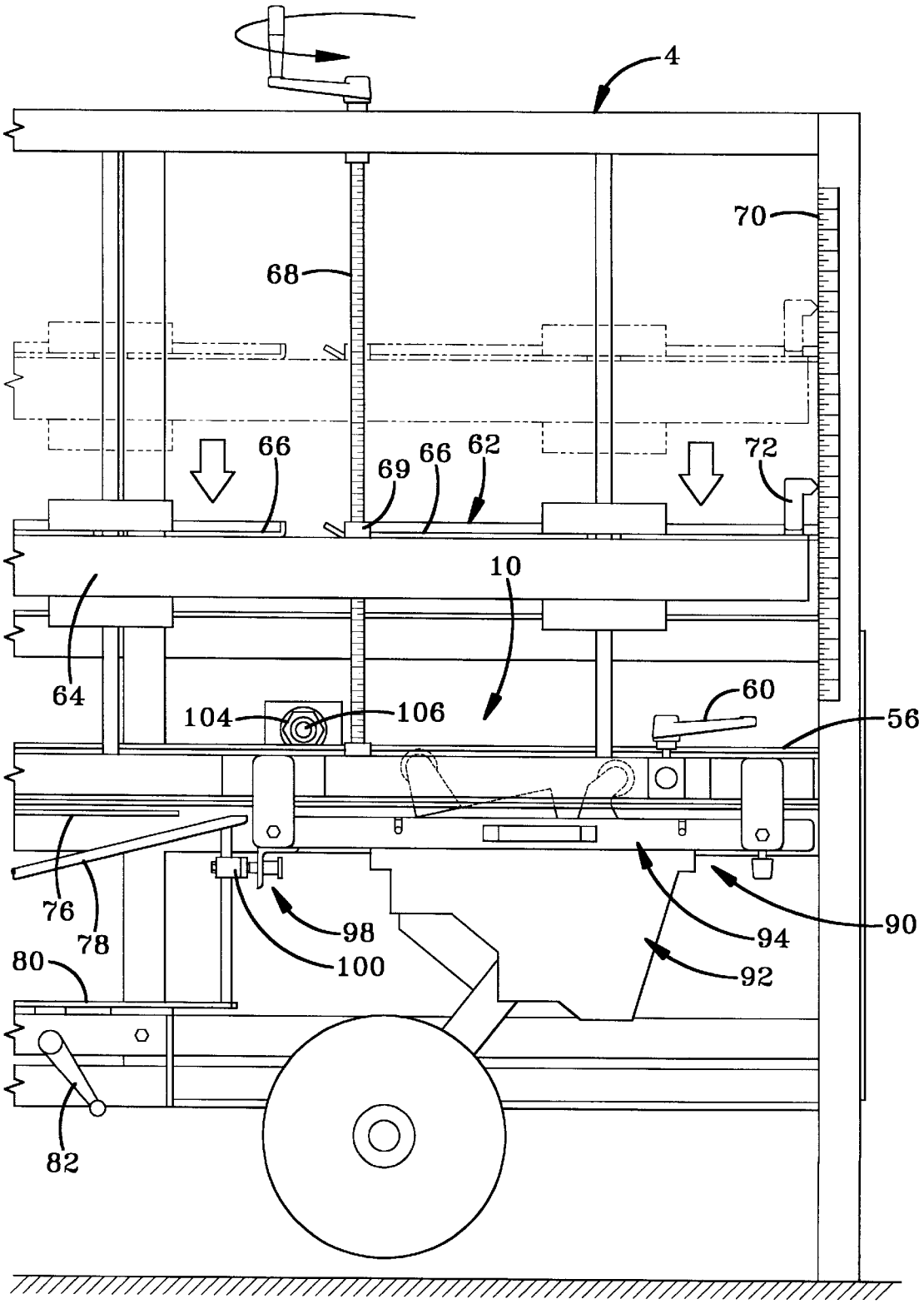
FIG. 9 is a front elevational view of a portion of the box erecting machine of the present invention depicting vertical movement of the box hold down plates.
Figure 10:
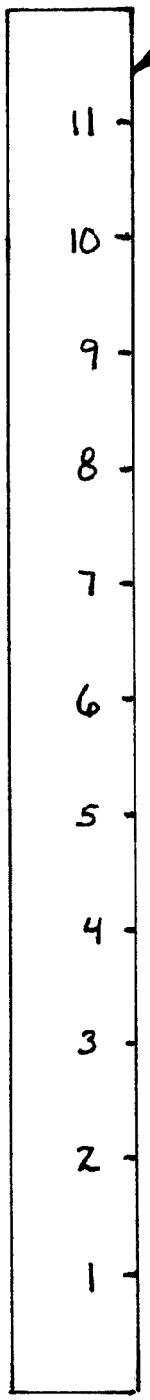
FIG. 10 is a view of one embodiment of the measurement scale of the present invention.
Figure 11:
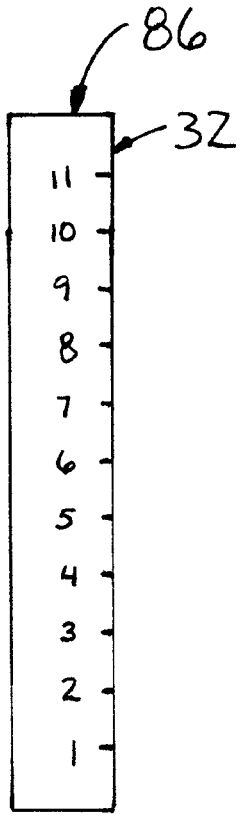
FIG. 11 is a view of one embodiment of the half scales of the present invention.
Figure 12:
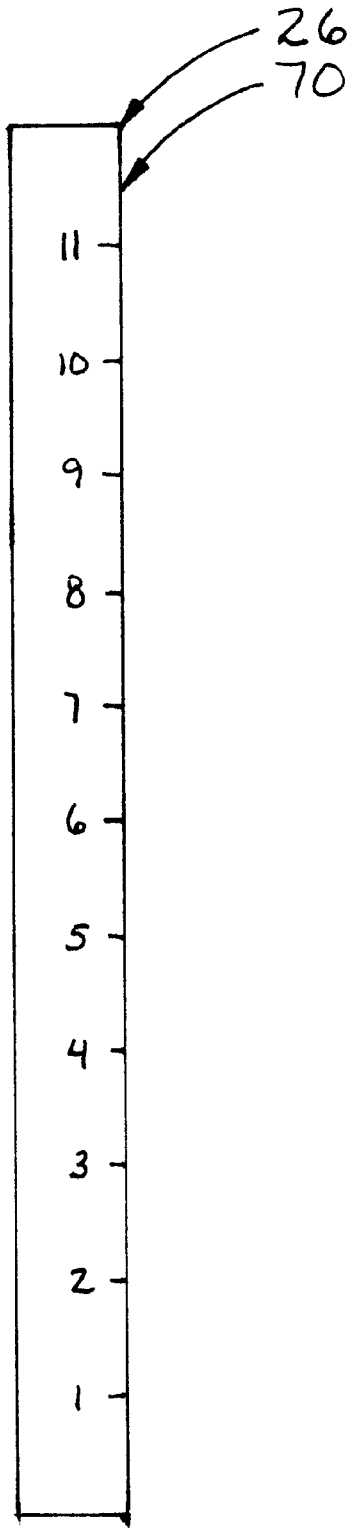
FIG. 12 is a view of one embodiment of the full scales of the present invention.

Box hold down assembly 62 includes a box hold down frame 64 that carries a pair of box hold down plates 66. Box hold down frame 64 is adjustable vertically with respect to frame 4 by rotation of a threaded box hold down adjustment crank 68 rotatably attached to frame 4 and threadably connected with a collar 69 connected to box hold down frame 64. As can be seen in FIG. 9, a box hold down height scale 70 is located on frame 4, and a box hold down height pointer 72 is mounted on box hold down frame 64.

Figure 7:
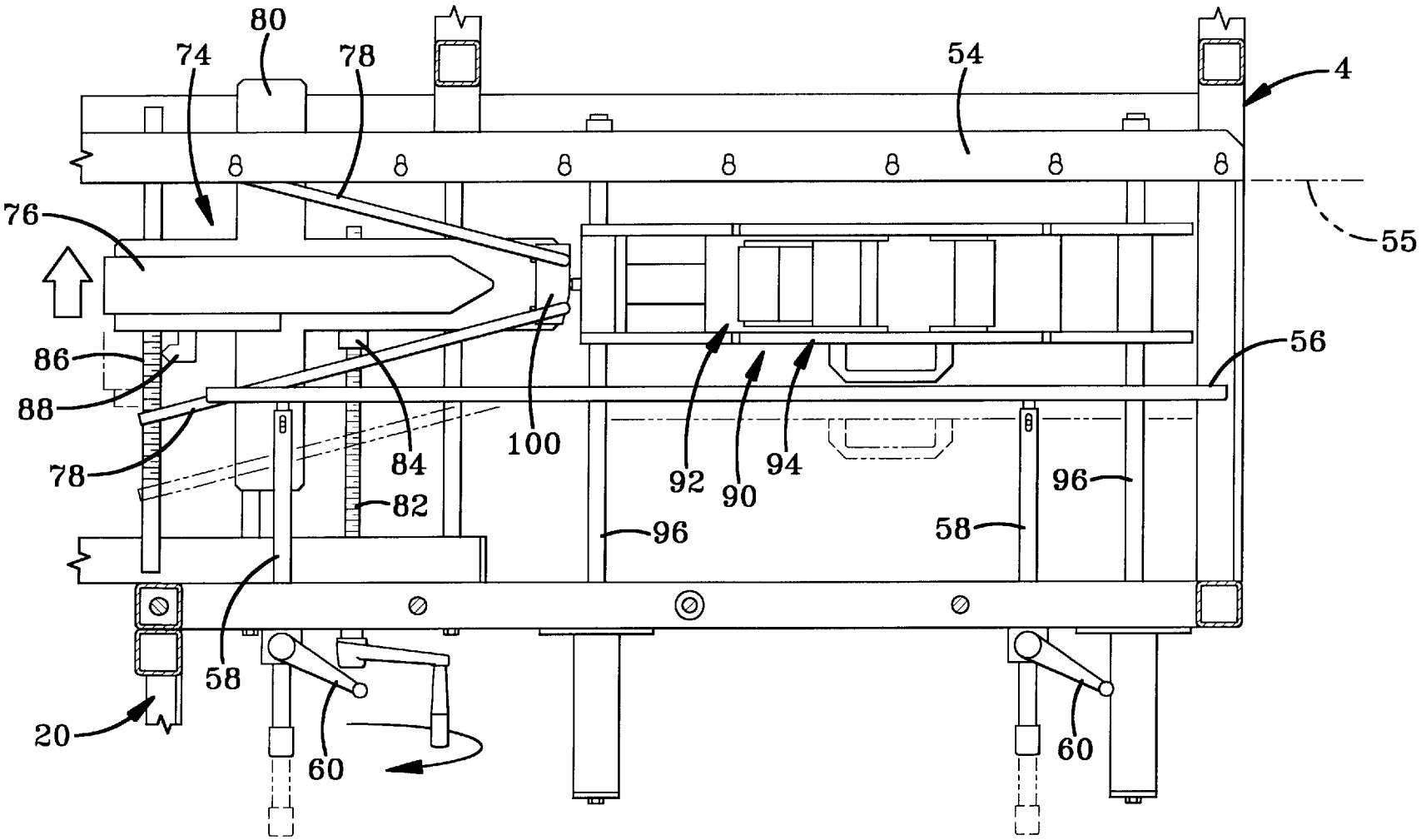
FIG. 7 is a top plan view of a portion of the box erecting machine taken immediately below the box hold down assembly and depicting horizontal movement of the box folding and box taping structures and horizontal movement of the adjustable guide rail of the present invention.

Flap folding station 8 includes one of box hold down plates 66 and a flap closure apparatus 74. Flap closure apparatus 74 includes a fold plate 76 and a pair of deflection bars 78 attached to a mounting plate 80. Flap closure apparatus 74 is horizontally adjustable with respect to frame 4 by operation of a threaded centering crank 82 rotatably mounted to frame 4 and connected threadably with a cooperatively threaded block 84 attached to mounting plate 80. As can be seen in FIG. 7, a flap closure adjustment scale 86 extends between parallel members of frame 4 adjacent flap closure apparatus 74, and a flap closure adjustment pointer 88 is mounted on mounting plate 80.

In operation, fold plate 76 folds the leading flap of the box inward as the box passes fold plate 76. Deflection bars 78 are a pair of elongated bars that extend generally upwardly and inwardly in a downstream direction toward box taping station 10. After the leading (minor) flap of the box has been folded inwardly (i.e., rearwardly), by fold plate 76, the flaps parallel with rails 54 and 56 (major taps) contact deflection bars 78 and are folded inwardly thereto toward one another. It is understood that the trailing (minor) flap of the box has already been folded by operation of kick plate 48 prior to the folding by deflection bars 78 of the flaps adjacent rails 54 and 56.

In passing over flap closure apparatus 74, the flaps of the box have been folded such that the leading and trailing flaps (minor flaps) are folded inward with the flaps adjacent rails 54 and 56 (major flaps) folded inward over them. With the bottom flaps folded as such, the box is then directed toward box taping station 10 for the taping operation.

Box taping station 10 includes the other box hold down plate 66 and a tape head mechanism 90. Tape head mechanism 90 containing a tape head 92 and a cradle 94 in which tape head 92 is mounted. In accordance with the objectives of the present invention, cradle 94 is slidably mounted on a pair of horizontal bars 96 which are fixedly attached at one end thereof to frame 4. Tape head 92 is maintained in operational alignment with flap closure apparatus with a pin assembly 98 which engages a corresponding recess (not shown) formed on a locking plate 100 attached to mounting plate 80. It is understood that in alternative embodiments of the present invention (not shown), locking plate 100 may be connected directly with block 84.

Tape head 92 is a conventional tape head of the type known and understood in the relevant art. Tape head 92 may, for instance, be an ACCUGLIDE® II Taping Head manufactured by the Minnesota Mining and Manufacturing Co. of Minneapolis, Minn., although other tape heads may be used without departing from the spirit of the present invention. Push bar 52 pushes boxes through flap folding station 8 to a point where the boxes have partially entered box taping station 10. As is best shown in FIG. 9, a space exists between box hold down plates 66. When box unfolding frame 41 translates a box toward flap folding station 8, push bar 52 (attached to box unfolding frame 41) translates the previously opened box across flap closure apparatus 74 and into box taping station 10. Push bar 52 then rotates upwardly through an angle approximately 90 degrees, passing through the space between box hold down plates 66. As is best shown in FIG. 9, a translation head 104 containing a telescoping rod 106 that extends therefrom translates the box through box taping station 10 and over tape head 92, thus completing the taping operation on the box.

Figure 4:
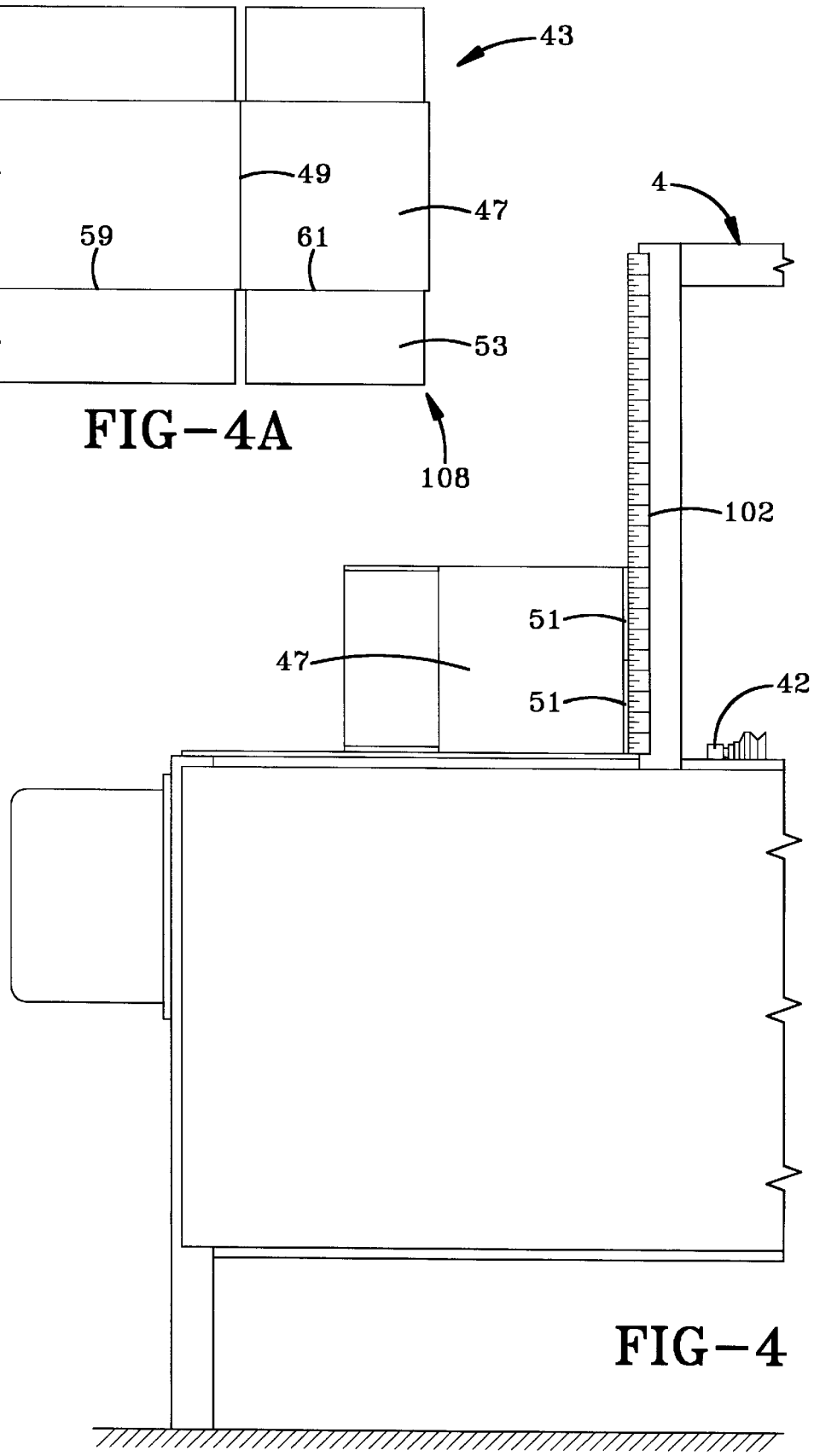
FIG. 4 is an enlarged view of a portion of the box erecting machine as is shown in FIG. 3 depicting measurement being taken of the box width.

The expedited setup of box erecting machine 2 is achieved as follows. First, the bottom flaps of a box are folded with the major flaps being folded over the minor flaps. The bottom flaps of the box are placed against a measurement scale 102 to measure the width of the box. FIG. 4 depicts the width measurement with the bottom major flaps resting against measurement scale 102, both of the aforementioned major flaps being horizontally oriented. The width measurement is then read from measurement scale 102 and noted.

Figure 1:
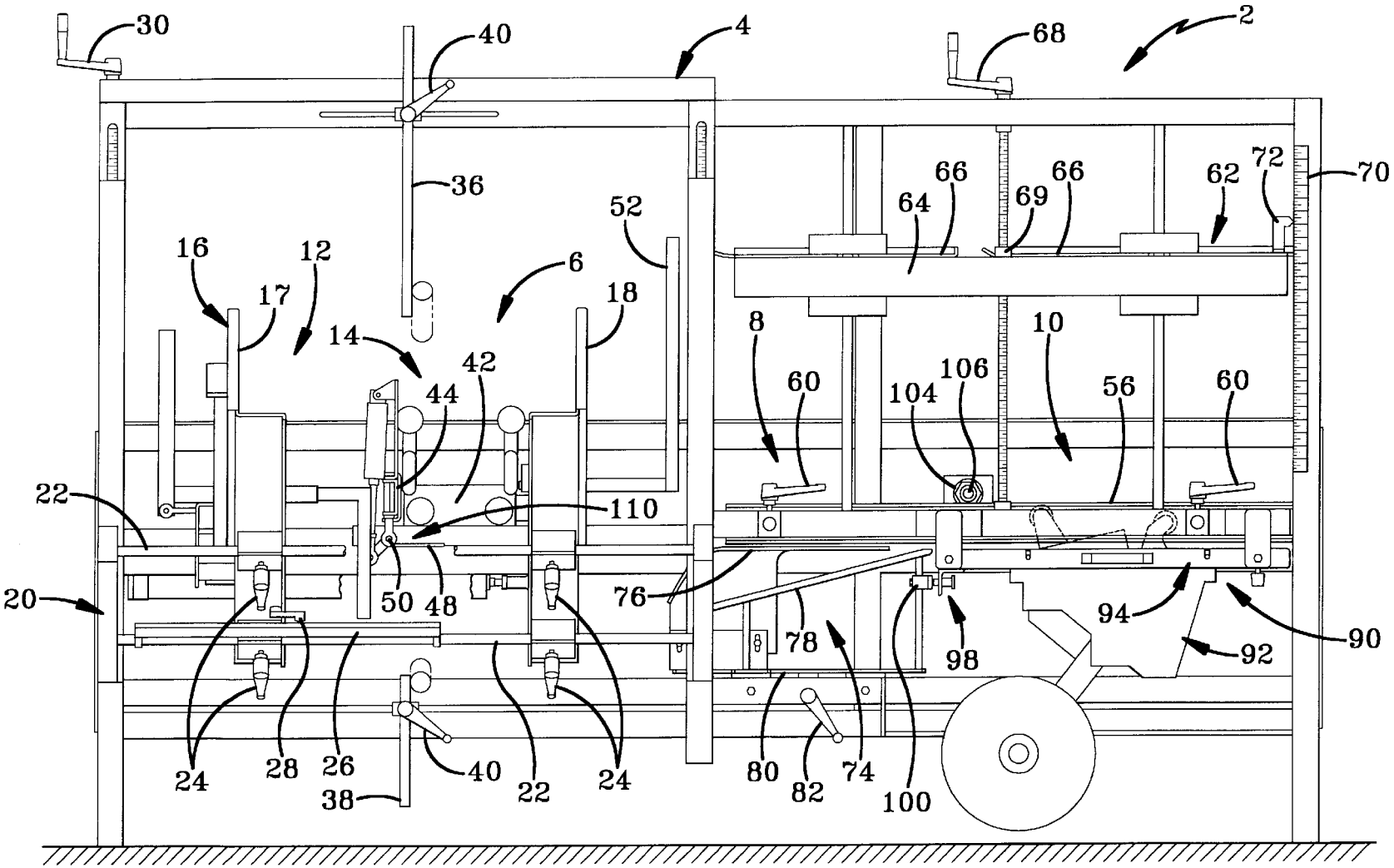
FIG. 1 is a front elevational view of the box erecting machine of the present invention.
Figure 5:
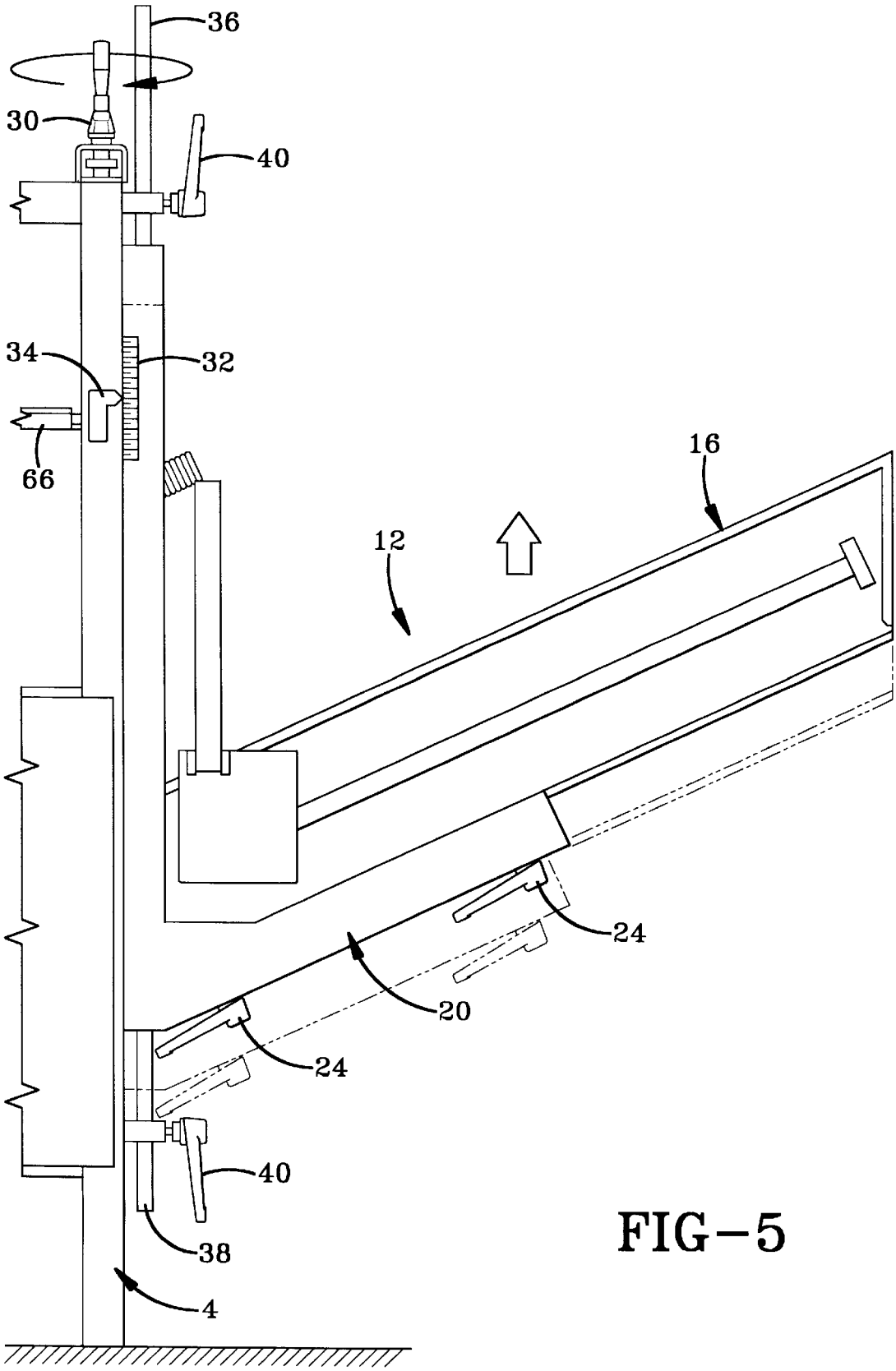
FIG. 5 is a left side elevational view of a portion of the box erecting machine depicting movement of the box magazine in the vertical direction.

The first adjustment involves the height of carriage 20. As is depicted in FIG. 5, magazine height adjustment crank 30 is then utilized to move carriage 20 until magazine height pointer 34 registers the aforementioned width measurement on magazine height scale 32. For example, if the width measurement is 8 inches, the user moves magazine height pointer 34 until it reaches the 8 setting on scale 32. As is understood in the relevant art, boxes 43 in the flat, unfolded configuration (FIG. 4A) are placed into box magazine 12 with flap corners 108 resting against channels 16 and 18. The vertical position of box magazine 12 must be adjusted such that minor flap juncture 61 aligns with the perpendicular intersection, as indicated at 110 in FIGS. 1–3, between the operative faces of box unfolding plate 44 and kick plate 48 immediately after the folding of the trailing minor flap.

As is understood in the relevant art, major flaps 51 extend outwardly from major panels 45 by the same distance that minor flaps 53 extend outwardly from minor panels 47. Thus, while major and minor flaps 51 and 53 may be of different lengths depending upon the dimensions of the box, major and minor flaps 51 and 53 will, nevertheless, be of equal widths. As indicated hereinbefore, and as depicted in FIG. 4, the width of the box is measured, and the width of the box is equal to twice the width of the major flaps. Thus, the proper vertical positioning of box magazine 12 is a function of the width measurement taken from scale 102 as described hereinbefore and depicted in FIG. 4. Specifically, magazine height adjustment crank 30 is rotated until magazine height pointer 34 reaches the position on magazine height scale 32 corresponding with the width measurement of the box. It is thus understood that magazine height scale 32 is a half scale with respect to scale 102 and is positioned and configured such that upon adjustment of carriage 20 to the point at which magazine height pointer 34 registers the aforementioned width measurement on magazine height scale 32, the vertical position of box magazine 12 will be such that minor flap juncture 61 aligns with the perpendicular intersection 110 of box unfolding plate 44 and kick plate 48 as set forth above.

It is further understood that the aforementioned width measurement is that of the entire box, i.e., twice the width of one of major flaps 51. For instance, a box having a width of twenty inches would have major and minor flaps 51 and 53 each ten inches in width. Box magazine 12 would thus be properly adjusted vertically when the bottom edges of minor flaps 53 are ten inches below the aforementioned perpendicular intersection 110 of box unfolding plate 44 and kick plate 48.

The width measurement of the box thus bears a two-to-one relationship with the aforementioned vertical adjustment of carriage 20. In accordance with the features of the present invention, measurement scale 102 and magazine height scale 32 are likewise configured to bear a two-to-one relationship with each other. That is, measurement scale 102 might have consecutively numbered graduations one inch apart, and magazine height pointer would have correspondingly consecutively numbered graduations one-half inch apart. Thus, carriage 20 can be set at the graduation on magazine height scale 32 that indicates the width measurement of the whole box as measured on measurement scale 102, but carriage 20 will have been vertically adjusted only one-half the width, which corresponds with the width of a single minor panel. In accordance with the features of the present invention, therefore, carriage 10 can be vertically adjusted to the aforementioned width measurement of the box, yet the actual adjusted corresponds with the width of a minor panel.

The second adjustment involves scaled channel 16 and the width of magazine 12. Scaled channel 16 is slid horizontally until magazine width pointer 28 likewise reaches the point on magazine width scale 26 that corresponds with the aforementioned width measurement. As can be seen in FIG. 4, the width measurement taken of the box corresponds with the width of minor panel 47. As was indicated hereinbefore, when box 43 is unfolded by the operation of box unfolding plate 44 and suction plate 42, major panel 45 is attached to suction plate 42 and minor panel 47 rests against box unfolding plate 44. In such configuration, panel juncture 49 lines up with the perpendicular intersection, as shown at 110, between box unfolding plate 44 and suction plate 42. Thus, by adjusting scaled channel 16 such that vertical face 17 lies one box width away from the operative face of box unfolding plate 44 when perpendicular with suction plate 42, panel juncture 49 will line up precisely with the perpendicular intersection 110 of box unfolding plate 44 and suction plate 42 as is required to properly orient box magazine 12 in the horizontal direction. Thus, in accordance with the features of the present invention, the horizontal orientation of box magazine 12 is set to the same width measurement taken from measurement scale 102 and depicted in FIG. 4. It is thus understood that scale 26 is a full scale with respect to scale 102.

Once scaled channel 16 has been properly adjusted to the point that magazine width pointer 28 indicates the aforementioned width measurement on magazine width scale 26, scaled channel 16 is locked in position by operation of locking levers 24. Non-scaled channel 18 is then moved horizontally until just before the vertical face thereof contacts the unfolded box as is depicted in FIG. 6. As is understood in the relevant art, a certain level of clearance between channels 16 and 18 and the boxes contained therebetween is desirable to facilitate the unobstructed feeding of boxes and to prevent jamming and other conveyance problems. Locking levers 24 are used to lock non-scaled channel 18 in the aforementioned position.

The third adjustment involves the position of flap closure apparatus 74 and tape head mechanism 90. Centering crank 82 is used to adjust the position of flap closure apparatus 74 until flap closure adjustment pointer 88 registers on flap closure adjustment scale 86 the same width measurement which was taken from measurement scale 102 and was depicted in FIG. 4. Inasmuch as the box folding operation is performed at the center of the box between the major flaps, the centering of flap closure apparatus 74 is based upon the width of one major flap as measured from fixed guide rail 54. Thus, measurement scale 102 and flap closure adjustment scale 86 will bear the aforementioned two-to-one relationship with each other as was described hereinbefore with regard to magazine height scale 32. It is understood in this regard that flap closure adjustment scale 86 and flap closure adjustment pointer 88 are positioned and configured such that flap closure apparatus 74 is operationally centered in box erecting machine 2 when flap closure adjustment scale 86 registers the aforementioned width measurement.

Figure 8:
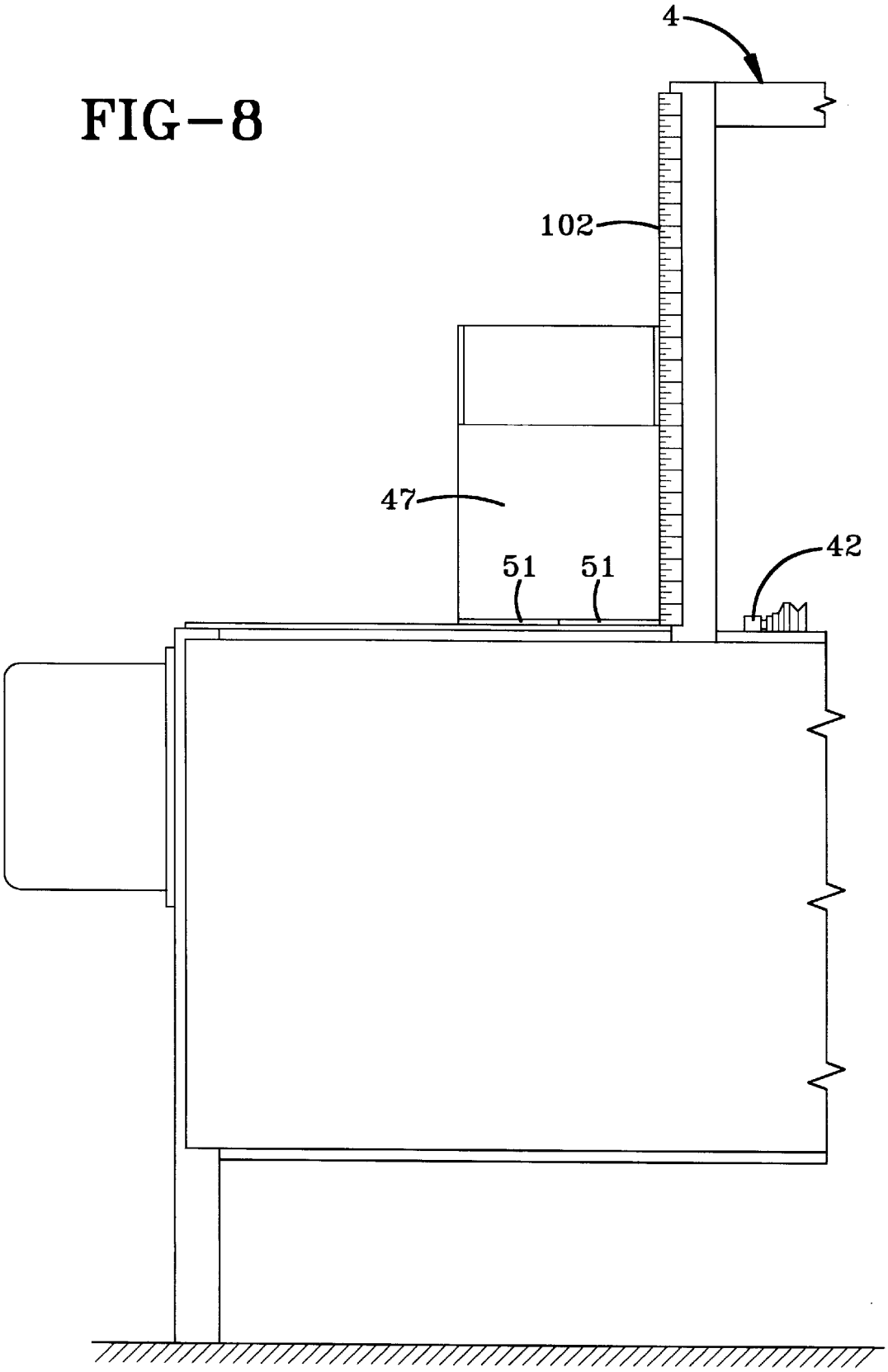
FIG. 8 is an enlarged view of a portion of the box erecting machine as is shown in FIG. 3 depicting measurement being taken of the box height.

The next step of the process is to take the second measurement. The bottom-folded box is placed upright against measurement scale 102 as is depicted in FIG. 8 to measure the height of the box including the unfolded top flaps. The height measurement is read and noted. The fourth adjustment is then positioned at hold down plates 66. As is depicted in FIG. 9, box hold down adjustment crank 68 is rotated until box hold down height pointer 72 registers on box hold down height scale 70 the aforementioned height measurement taken against measurement scale 102 as depicted in FIG. 8. In such position, box hold down plates 66 are at a height above cradle 94 corresponding with the height of the box, thus permitting the boxes to be held against flap closure apparatus 74 and tape head 92 while the box is folded and sealed, respectively. Box hold down height pointer 72 and box hold down height scale 70 are positioned and configured to achieve the aforementioned positioning of box hold down plates 66 when the aforementioned height measurement is indicated on box hold down height scale 70. Height scale 70 is thus a full scale.

The final adjustment involves placing the bottom-folded box underneath box hold down plates 66 and between fixed guide rail 54 and adjustable guide rail 56. Adjustable guide rail 56 is then adjusted an appropriate distance to provide sufficient contact with the box to ensure proper box feeding and orientation between guide rails 54 and 56, with locking levers 60 then being locked to retain adjustable guide rail 56 in position.

In accordance with the features of the present invention, a single width measurement taken against measurement scale 102 as depicted in FIG. 4 is used to calibrate three of the four critical set up parameters, i.e., vertical and horizontal positioning of box magazine 12 and centering of flap closure apparatus 74. The three aforementioned adjustments are thus set to a common setting based upon a single dimension of the boxed being assembled. Likewise, the fourth critical parameter, i.e., vertical positioning of box hold down plates 66, is set to correspond with the height measurement of the box taken from measurement scale 102. The other two adjustments, i.e., horizontal adjustment of non-scaled channel 18 and horizontal adjustment of adjustable guide rail 56 are simply adjusted to an appropriate point against a box loaded into box erecting machine 2.

In accordance with the features of the present invention, therefore, the setup of box erecting machine 2 has been significantly expedited inasmuch as the width and height of the box are readily measured, and the two measurements are used to set the four critical parameters necessary to set up box erecting machine 2. Further, the person setting up machine 2 does not have to perform any calculations because each scale 26, 32, 70 and 86 is scaled to automatically perform the required calculations. For instance, if the width of the box is 10 inches as measured by scale 102, the user sets the adjustable stations such that each pointer registers to the "10" setting on its scale. The user does not have to remember which adjustments are halved because of the use of the half scales. The configuration of box erecting machine 2 to be set up according to the dimensions of the box to be assembled overcomes many of the problems inherent in previous box erecting machines by obviating the trial and error adjustments that were required to set up such box erecting machines.

While each of scales 26, 32, 70, and 86, have been shown to correspond either directly or in a two-to-one relationship with scale 102 according to a common unit of measurement such as inches, it is understood that any type of scaling or graduation system could be used to facilitate setup of box erecting machine 2. For instance, a user of box erecting machine 2 might typically assemble only a limited number of different types of boxes. In this circumstance, each of the aforementioned scales could be marked with graduations indicating "box 1", "box 2", "box 3", etc., at appropriate points. In such circumstance, the width and height of the box to be assembled would not need to be measured each time box erecting machine 2 was set up.

Still alternatively, each of the aforementioned scales could include different colored marks, the marks of any given color corresponding with a particular box being assembled, likewise facilitating set up of box erecting machine 2. Essentially any indication can be used on the aforementioned scales to correspond with a box to be assembled. It is understood, nevertheless, that box erecting machine 2 could be quickly set up to assemble virtually any size box by measuring the width and height of the box, adjusting the vertical and horizontal position of box magazine 12 and centering flap closure apparatus 74 to correspond with the measured width, setting box hold down assembly 62 to correspond with the measured height, and horizontally adjusting non-scaled channel 18 and adjustable guide rail 56 to the appropriate positions. Thus, box erecting machine 2 can be quickly set up to assemble boxes of different sizes without the painstaking and time consuming setup process previously known in the art.

It is understood that while scales 26, 32, 70, and 86 have been show to be mounted to frame 4, and the corresponding pointers mounted to the relevant movable structure, the configuration could be reversed whereby the scales could be mounted on the moving parts and the pointers mounted on the frame without departing from the spirit of the present invention.

Accordingly, the improved method and apparatus for setting up a box erecting machine is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved method and apparatus for setting up a box erecting machine is construed and used, the characteristics of the construction, and the advantageous, new and useful results obtained; the new and useful structures, devices, elements, arrangements, parts and combinations, are set forth in the appended claims.

What is claimed is:

1. A method for setting up a box erecting machine for a given box having a width and a height, the machine having a frame, a box magazine adjustable adjustably mounted on the frame, a box folding apparatus adjustable mounted on the frame, and a box hold down apparatus adjustable mounted on the frame; said method comprising the steps of:

obtaining the width and height of the given box before the given box is placed in the box erecting machine;

providing a first scale on one of the frame and the box magazine and a first pointer mounted on the other of the frame and the box magazine;

adjusting the box magazine with respect to the frame until the first pointer reaches and indicates a first setting on the first scale, the first setting corresponding with the width obtained for the given box; this adjusting step occurring before the given box is placed in the box erecting machine;

providing a second scale on one of the frame and the box magazine and a second pointer mounted on the other of the frame and the box magazine;

adjusting the box magazine with respect to the frame until the second pointer reaches and indicates a second setting on the second scale, the second setting corresponding with the width obtained for the given box; this adjusting step occurring before the given box is placed in the box erecting machine;

providing a third scale on one of the frame and the box folding apparatus and a third pointer mounted on the other of the frame and the box folding apparatus;

adjusting the box folding apparatus with respect to the frame until the third pointer reaches and indicates a third setting on the third scale, the third setting corresponding with the width obtained for the given box; this adjusting step occurring before the given box is placed in the box erecting machine;

providing a fourth scale on one of the frame and the box hold down apparatus and a fourth pointer mounted on the other of the frame and the box hold down apparatus;

adjusting the box hold down apparatus with respect to the frame until the fourth pointer reaches and indicates a fourth setting on the fourth scale, the fourth setting corresponding with the height obtained for the given box; this adjusting step occurring before the given box is placed in the box erecting machine;

the first and third scales being half scales and the second and fourth scales being full scales.

2. The method as set forth in claim 1, further comprising the steps of providing a fifth scale on the frame of the box erecting machine and measuring the width of the given box on the fifth scale.

3. The method as set forth in claim 2, further comprising the step of measuring on the fifth scale the height of the given box, the given box being measured with the bottom flaps thereof folded and with the top flaps thereof unfolded.

4. The method as set forth in claim 3, wherein the step of adjusting the box magazine with respect to the frame until the first pointer reaches a first setting on the first scale causes the box magazine to move in a first direction with respect to the frame and the step of adjusting the box magazine with respect to the frame until the second pointer reaches a second setting on the second scale is performed in a second direction with respect to the frame, the first direction being substantially perpendicular to the second direction.

5. A box erecting machine for erecting a given box, the box having at least a first physical dimension, the machine comprising:

a frame;

at least one box manipulation station adjustably mounted on said frame;

a first scale mounted on one of said box manipulation station and said frame; and a first pointer mounted on the other of said box manipulation station and said frame, said pointer and said scale being positioned to provide an indication of the location of said box manipulation station with respect to said frame, the indication being scaled to the at least first physical dimension of the given box;

the box manipulation station being properly adjusted for the given box when the first pointer is aligned with a position on the first scale that corresponds to the first physical dimension of the given box; the first scale and first pointer allowing the box manipulation station to be adjusted for the given box before the given box is placed in the box manipulation station.

6. The box erecting machine as set forth in claim 5, wherein said box manipulation station is in the form of a box magazine and said first scale being a half scale.

7. The box erecting machine as set forth in claim 6, further comprising a second scale mounted on one of said box magazine and said frame and a second pointer mounted on the other of said box magazine and said frame; said second scale being a full scale.

8. The box erecting machine as set forth in claim 7, wherein said box magazine moves with respect to said first scale in a first direction and moves with respect to said second scale in a second direction, said first direction being substantially perpendicular to said second direction.

9. The box erecting machine as set forth in claim 5, wherein said box manipulation station is in the form of a box folding apparatus and said first scale being a half scale.

10. The box erecting machine as set forth in claim 5, wherein said box manipulation station is in the form of a box hold down apparatus and said first scale is a full scale.

11. In a box erecting machine for setting up a given box, the given box having a physical dimension, the machine being of the type having an adjustable box manipulation station mounted on a frame, the improvement comprising:

a first scale mounted on one of the box manipulation station and the frame;

a first pointer mounted on the other of the box manipulation station and the frame; and the first scale corresponding to the physical dimension of the given box;

the box manipulation station being properly adjusted for the given box when the first pointer is aligned with a position on the first scale that corresponds to the first physical dimension of the given box; the first scale and first pointer allowing the box manipulation station to be adjusted for the given box before the given box is placed in the box manipulation station.

12. The improvement as set forth in claim 11, wherein said first scale is a half scale.

13. The improvement as set forth in claim 11, further comprising a second scale mounted on one of the box manipulation station and the frame; a second pointer mounted on the other of the box manipulation station and the frame; and the second scale being a full scale and corresponding to the physical dimension of the given box.

14. A method for setting up an adjustable station of a box erecting machine to function with a given box, the given box having a width and a height, the box erecting machine having a frame, the method comprising the steps of:

obtaining the width and height of the given box before adjusting the machine;

providing a scale on one of the adjustable station and the frame of the box erecting machine; the scale having markings that correspond to the dimensions of the boxes that the machine is capable of setting up;

providing a pointer on the other of the adjustable station and the frame of the box erecting machine; and adjusting the position of the adjustable station with respect to the frame until the pointer reaches and indicates a first setting on the scale, the first setting adapted to correspond with one of the width and height of the given box; the adjusting step being performed before the given box is placed in the adjustable station; the adjustable station being set up for the given box when the pointer reaches this position.

15. The method of claim 14, further comprising the step of measuring the width of the given box and adjusting the position of the adjustable station until the pointer reaches a marking on the scale equal to the width measurement of the given box.

16. The method of claim 15, further comprising the step of providing a half scale with markings equaling the width measurement of the given box.

17. The method of claim 15, further comprising the step of providing a full scale with markings equaling the width measurement of the given box.

18. The method of claim 14, further comprising the step of measuring the height of the given box and adjusting the position of the adjustable station until the pointer reaches the height measurement on the scale.

19. A method for setting up an adjustable station of a box erecting machine to function with a given box, the given box having a width and a height, the box erecting machine having a frame, the method comprising the steps of:

obtaining the width and height of the given box;

providing a scale on one of the adjustable station and the frame of the box erecting machine; the scale having markings that correspond to the dimensions of the boxes that the machine is capable of setting up;

providing a pointer on the other of the adjustable station and the frame of the box erecting machine; and manually adjusting the position of the adjustable station with respect to the frame until the pointer reaches and indicates a first setting on the scale, the first setting adapted to correspond with one of the width and height of the given box; the adjustable station being set up for the given box when the pointer reaches this position.

20. The method of claim 19, wherein the scale is a half scale.

* * * * *